US008881655B2

(12) United States Patent
Aw et al.

(10) Patent No.: US 8,881,655 B2
(45) Date of Patent: Nov. 11, 2014

(54) PROJECTILE WITH STRIKE POINT MARKING

(75) Inventors: Cheng Hok Aw, Singapore (SG); Boon Siong Chong, Singapore (SG); Kar Hin Cheang, Singapore (SG); Chun Kang Koh, Singapore (SG); Renjie Xie, Singapore (SG)

(73) Assignee: Advanced Material Engineering Pte Ltd, Singapore (SG)

( * ) Notice: Subject to any disclaimer, the term of this patent is extended or adjusted under 35 U.S.C. 154(b) by 80 days.

(21) Appl. No.: 13/823,740

(22) PCT Filed: Sep. 10, 2011

(86) PCT No.: PCT/SG2011/000308

§ 371 (c)(1),
(2), (4) Date: Jun. 11, 2013

(87) PCT Pub. No.: WO2012/036632

PCT Pub. Date: Mar. 22, 2012

(65) Prior Publication Data

US 2014/0041545 A1 Feb. 13, 2014

(30) Foreign Application Priority Data

Sep. 16, 2010 (SG) ..... 201006718-9

(51) Int. Cl.

| | |
|---|---|
| ***F42C 13/02*** | (2006.01) |
| ***F42B 12/40*** | (2006.01) |
| ***F42B 8/12*** | (2006.01) |

(52) U.S. Cl.

CPC .. *F42B 12/40* (2013.01); *F42B 8/12* (2013.01)

USPC ..... 102/513; 102/512

(58) Field of Classification Search

USPC ..... 102/512, 513

See application file for complete search history.

(56) References Cited

U.S. PATENT DOCUMENTS

| | | | |
|---|---|---|---|
| 7,004,074 | B2 | 2/2006 | Van Stratum |
| RE40,482 | E | 9/2008 | Haeselich |
| 7,475,638 | B2 | 1/2009 | Haeselich |
| 2008/0053330 | A1 | 3/2008 | Haeselich |
| 2010/0175577 | A1 | 7/2010 | Iadyjensky |

OTHER PUBLICATIONS

International Search Report of international patent application No. PCT/SG2011/000308 completed on Oct. 20, 2011 and mailed Oct. 28, 2011 (3 pages).

*Primary Examiner* — Daniel J Troy
(74) *Attorney, Agent, or Firm* — Pyprus Pte Ltd

(57) ABSTRACT

The present invention describes a projectile (100,100*a*,100*b*, 100*c*,100*d*) containing two luminescent dye components (123,125) and a dye powder (126). The first luminescent dye component (123) is contained in an ampoule (122) while the second luminescent dye component is contained in a vial (124) disposed inside the ampoule (122). A front crusher (120,120*a*) is provided at a front of the ampoule to crush into the ampoule and vial, thereby allowing the dye components to react and give a luminous glow. Upon impact at a target, a nose cap (110) of the projectile (100,100*a*,100*b*,100*c*,100*d*) breaks and a rear crusher (130) behind the ampoule throws the ampoule (122) forward and sputters the luminous dye out of the nose cap (110); at the same time, the dye powder (126) surrounding the ampoule is sputtered out to mark the point of impact. In addition, a thermal glow is also provided to mark the point of impact. Projectiles also allow light tracing.

24 Claims, 6 Drawing Sheets

PROJECTILE WITH STRIKE POINT MARKING

FIELD OF INVENTION

The present invention relates to projectiles with strike point marking. In particular, these projectiles are useful for training purposes or for use as marker rounds.

BACKGROUND

Practice ammunition has been in use. For example, U.S. Pat. No. 7,004,074, assigned to Martin Electronics, describes a practice projectile 10 containing a powder dye charge 14 (see FIG. 1). After the projectile is fired, the nose cone 11 bonded to the projectile 12 ejects the dye at the point of impact. It appears that this projectile is limited to day time use.

In another example, U.S. Pat. No. RE40,482, assigned to Nico-Pyrotechnik Hanns-Juergen, describes a practice projectile in which a marking agent is contained in a frangible hood at the head of the projectile. The marking agent consists of two chemical components contained in separate, adjacent compartments. These compartments share a common partition that has predetermined thin regions. When fired, the acceleration forces on the projectile break these thin wall regions to allow the two chemical components to react and give a chemo-luminescent light. The luminous light is emitted through the transparent hood while the projectile is in flight. Upon striking the target, the hood bursts to scatter the luminous chemical dye, thereby making the strike point optically visible. It appears that this projectile is limited to night time use.

U.S. Pat. No. 7,475,638, also assigned to Nico-Pyrotechnik Hanns-Juergen, describes an improved projectile 50 that is usable for both day and night time use. In this projectile, two chemically active marking materials are separately contained in two containers 55, which are placed side-by-side to each (see FIG. 2). These containers 55 are then encased in an outer container 56. The outer container 56 is embedded in a dye powder 54 disposed inside a front cavity. When the projectile 50 strikes a target, the front cavity bursts and the containers 55,56 become broken; as a result, the dye powder 54 is released and the two chemically active components react to give out light. It appears that the chemically active components mix and react at the point of impact and the chemical reaction may not give an optimal luminous effect.

It is appreciated that larger quantities of projectiles are used in training than in service; as such, cost becomes a very important factor in providing training projectiles. Coupled with limitations of known projectiles, it can thus be seen that there exists a need for other types of training projectiles to meet current and future challenges.

SUMMARY

The following presents a simplified summary to provide a basic understanding of the present invention. This summary is not an extensive overview of the invention, and is not intended to identify key features of the invention. Rather, it is to present some of the inventive concepts of this invention in a generalised form as a prelude to the detailed description that is to follow.

The present invention seeks to provide a frangible projectile with strike point marking for training purposes or for use as marker rounds during both day and night. The luminescent dye contained in the projectile is activated after the projectile is launched and the flight time allows the luminescent dye to produce an effective glow at the point of impact.

In one embodiment, the present invention provides a projectile having a hollow nose cap threadedly connected to a forward portion of a projectile body and a cartridge case bonded to a rear portion of said projectile body, such that said projectile is elongate and defines a longitudinal axis. The projectile comprises: an ampoule disposed inside said hollow nose cap, with said ampoule's longitudinal axis substantially coaxial with said longitudinal axis of said projectile, and said ampoule contains a first luminescent dye component; a vial disposed inside said ampoule, with said vial containing a second luminescent dye component; a front crusher disposed at a front end of said ampoule; and a rear crusher disposed at a rear end of said ampoule; wherein upon launching of said projectile, impulse of said front crusher crushes said front end of said ampoule and said vial, thereby allowing said first and second luminescent dye components to mix and produce a luminous glow, and upon said projectile striking a target, said nose cap breaks and then said rear crusher throws said luminous dye out of said broken nose cap to mark the point of impact of said projectile.

In one embodiment, the projectile comprises a dye powder disposed around said ampoule and front crusher, and said dye powder comprises a catalyst that is reactable with said luminescent dye to produce a stronger glow. In another embodiment, the dye powder is contained in a sachet. In another embodiment, the projectile contains a phosphorus compound that is ignited when the rear crusher is thrown out of the projectile body during impact and this provides a thermal glow that is noticeable with night vision equipment. In another embodiment, the rear of the projectile has a transparent plug/window or channel and the luminous glow of the dye is emitted through the transparent plug so that the projectile's trajectory can be traced or plotted. The channel allows hot propulsion gas to thaw the luminescent dye when the projectile is used in a cold environment.

In another embodiment, the present invention provides a method for marking a strike point of a projectile noticeable. The method comprises: breaking an ampoule and a vial contained in said ampoule by a front crusher, mixing two luminescent dye components separately contained in said ampoule and vial to give a luminous glow; breaking open a nose cap of said projectile along a line of thickness transition upon impact at a strike point; and sputtering said luminous dye out of said broken nose cap by a rear crusher to mark the strike point; wherein said method is used during the night and with the aid of a night vision camera.

In another embodiment, the method comprises igniting said oxidant and phosphorus compound to provide a thermal glow as said rear crusher is thrown out of said projectile body at the point of impact. In yet another embodiment, the method comprises emitting the luminous light through a transparent plug/window or channel disposed at a rear of the projectile body for tracing or plotting the projectile's trajectory.

BRIEF DESCRIPTION OF THE DRAWINGS

This invention will be described by way of non-limiting embodiments of the present invention, with reference to the accompanying drawings, in which.

DETAILED DESCRIPTION

Figure 1:
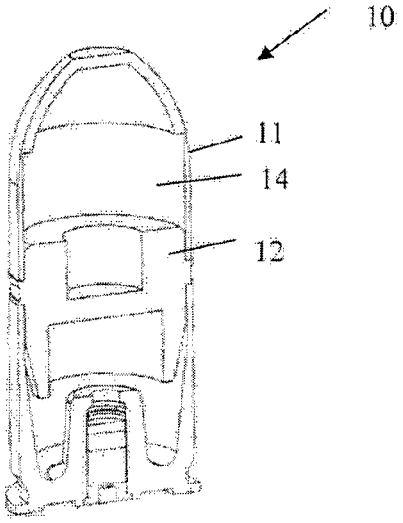
FIG. 1 (Prior Art)
FIG. 1 illustrates a known training ammunition as described in U.S. Pat. No. 7,004,074.
Figure 2:
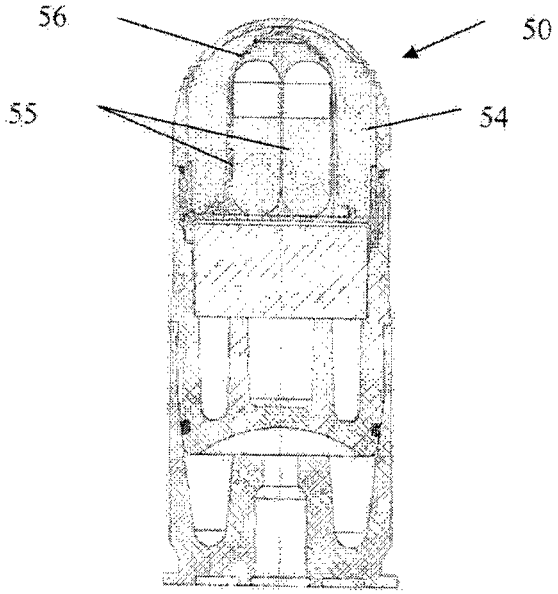
FIG. 2 (Prior Art)
FIG. 2 illustrates another known training ammunition as described in U.S. Pat. No. 7,475,638.

One or more specific and alternative embodiments of the present invention will now be described with reference to the attached drawings. It shall be apparent to one skilled in the art, however, that this invention may be practised without such specific details. Some of the details may not be described at length so as not to obscure the invention. For ease of reference, common reference numerals or series of numerals will be used throughout the figures when referring to the same or similar features common to the figures. Front/forward or rear orientation of any component is with respect to the travel direction of the projectile.

Figure 3A:
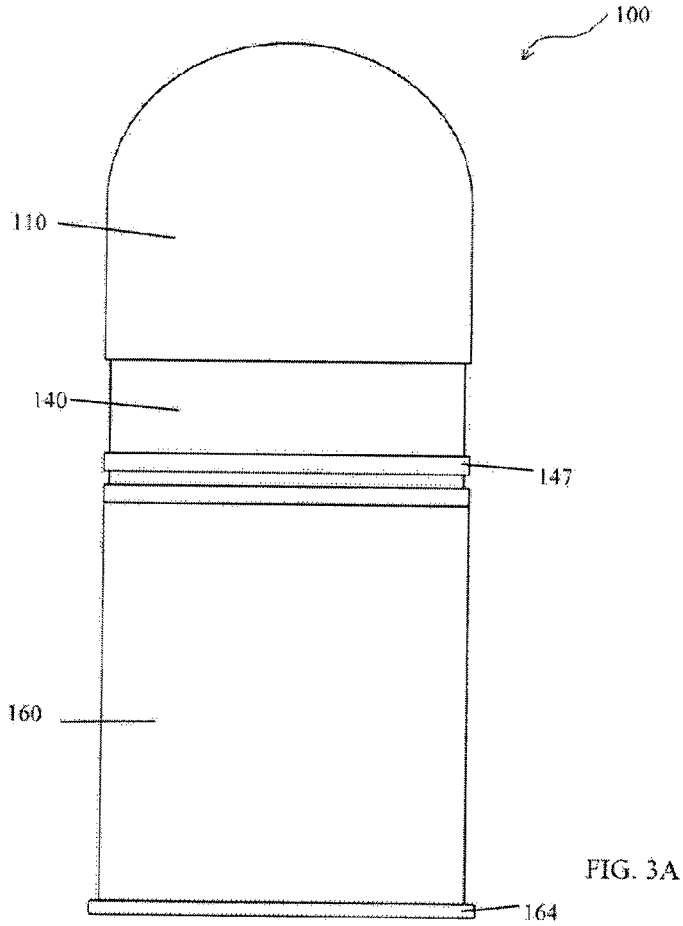
FIG. 3A illustrates a projectile according to an embodiment of the present invention.
Figure 3B:
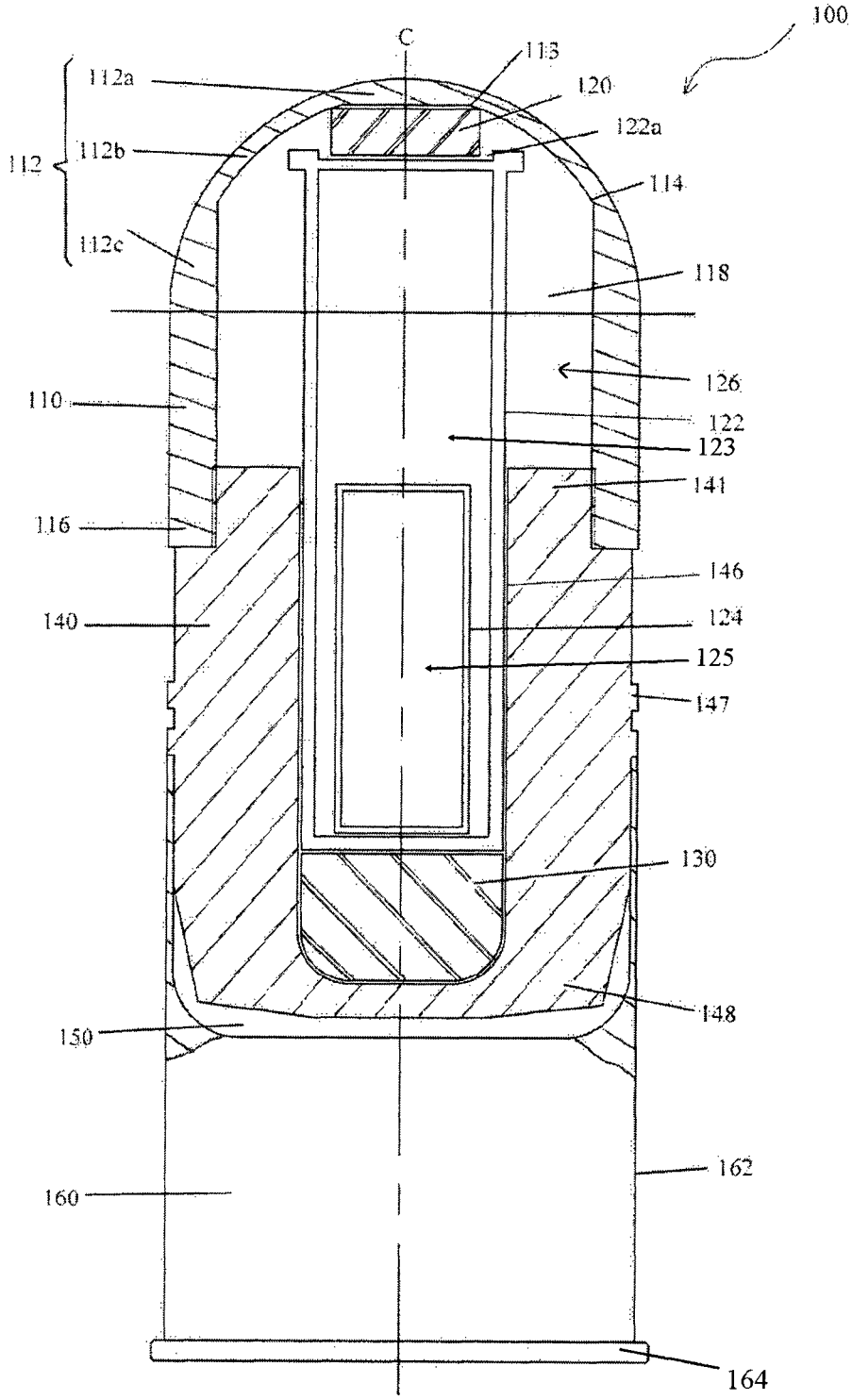
FIG. 3B illustrates a cross-section view of the training projectile shown in FIG. 3A.

FIG. 3A shows a projectile 100 according to an embodiment of the present invention. FIG. 3B shows a cross-section of the projectile 100. As shown in FIGS. 3A and 3B, the projectile 100 comprises a plastic nose cap 110 threaded onto a forward end of a projectile body 140, with a rear portion of the projectile body 140 being bonded to a cartridge case 160. The plastic nose cap 110 is designed to break upon striking a target. The projectile 100 is generally elongate along a centre axis C.

The front exterior of the nose cap or ogive 110 is substantially hemispherical in shape and it extends to its rear 116 in a cylindrical shape. As can be seen from FIG. 3B, the nose cap forms a shell 112 and defines a cavity 118 therein. The shell 112 comprises three regions of varying thicknesses; at the front tip region 112*a*, the interior surface is substantially flat; this flat surface is dimensioned to accept a front crusher 120. The tip region 112*a* continues to a middle region 112*b*, which is partially hemispherical but relatively thinner than the tip region 112*a*. The third region 112*c* is substantially cylindrical in manner and has a thickness substantially twice the thickness of the middle region 112*b*. The changes in the thicknesses of the shell 112 at the three regions formed two transition lines 113,114 on the interior surface of the shell 112. These transition lines 113,114 define lines of weaknesses along which the shell 112 or nose cap 110 is susceptible to break upon experiencing an impact. In one embodiment, the nose cap 110 is made of high-impact polycarbonate. Preferably, the nose cap 110 is translucent or opaque; these features will become clearer when other embodiments are described.

A front end 141 of the projectile body 140 has a recess 146 at its centre, with respect to the centre axis C. The recess 146 is cylindrical in section and has a round bottom. The bottom of the recess 146 is shaped and dimensioned to receive a rear crusher 130. The outer surface of the projectile body 140 between the connections with the nose cap 110 and the cartridge case 160 has two projected rings 147. The ring 147 surfaces have substantially the same dimension as the outside cylindrical surface of the nose cap 110 so that they fit with a bore of a launcher (not shown in the figures) to spin stabilise the projectile 100.

The cartridge shell 160 has a generally cylindrical outside surface 162. The base of the cartridge shell 160 extends out of the cylindrical surface 162 to form a flange 164, which helps retain a spent cartridge shell in the firing chamber of the launcher. The cartridge shell 160 for use with this invention is typically known and therefore no further description of the cartridge shell is provided. When assembled with the projectile body 140, there is a space 150 between a rear end 148 of the projectile body 140 and an interior of the cartridge shell 160. The space 150 forms a low pressure chamber for propulsion gas to eject the projectile 100 through the bore of its launcher.

When the projectile 100 is assembled, the centre, with respect to the centre axis C, of the cavity 118 between the front interior end of the nose cap 110 and the recess 146 on the projectile body 140 is located, in contiguous contact, the front crusher 120, an ampoule 122 and the rear crusher 130. The ampoule 122 is a plastic container containing a first luminescent dye component 123. Inside the ampoule 122 is a glass vial 124, which contains a second luminescent dye component 125 that reacts with the first luminescent dye component 123 to give a luminous glow. The space in the cavity 118 surrounding the front crusher 120 and ampoule 122 is packed with a coloured dye powder 126. In one embodiment, the front and rear crushers 120,130 are made of metal, such as, steel or stainless steel. In one embodiment, the front crusher 120 is relatively smaller in size and mass than the rear crusher 130; for example, the front crusher 120 sits in a depression 122*a* formed on the front end of the ampoule 122 such that the outside diameter of the front crusher 120 is substantially smaller than an interior diameter of the ampoule 122, whilst the ampoule 122 and rear crusher 130 have substantially the same outside dimension. In terms of mass difference, the rear crusher 130 is substantially 50% to 80% heavier than the front crusher 120.

In use, when the projectile 100 is ejected from a launcher after firing, the projectile 100 experiences large acceleration and spin forces; as a result, the impulse imparted onto the front crusher 120 crushes the front end of the plastic ampoule 122 and the glass vial 124 contained therein; this causes the first and second luminescent dye components 123,125 to react with each other. The spin forces and the front crusher 120 additively cause turbulent mixing of the first and second luminescent dye components 123,125 to give a luminous glow, even when the projectile 100 is in flight. When the projectile 100 hits its target, the impact of the projectile 100 causes the plastic nose cap 110 to crack or break at the thickness transition lines 113,114 whilst the impulse of the rear crusher 130 throws the ampoule 122 forward to release the luminous dye and provides a luminous effect at the point of impact; this is advantageous during night time training when night vision cameras are used; in addition, this projectile 100 may be used as a marker round to pin point a target. The impact forces also cause the coloured dye powder 126 to sputter and to provide a visible effect at the point of impact during day time training. The sputtering of the dye powder 126 carries with it the luminous dye, causing the point of impact to be more visible from a distance. In addition, the coloured dye powder 126 also contains a catalyst to give the luminous dye a stronger glow after the projectile 100 hits its target.

Figure 4A:
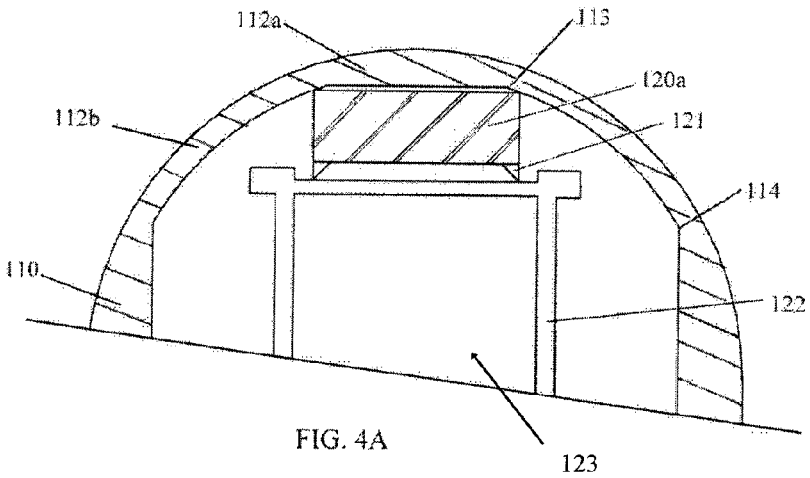
FIG. 4A illustrates a cutting edge on a front crusher according to another embodiment of the present invention.

In another embodiment of the front crusher, the front crusher 120*a* additionally comprises a cutting edge 121 around a periphery of its rear face that is in contact with the front end of the ampoule 122, as seen in FIG. 4A. The cutting edge 121 may be a continuous cutting edge, a saw-tooth cutting edge or discrete sections of cutting edges. Advantageously, the present invention makes use of the spin forces on the front crusher 120*a* to ensure that the ampoule 122 and vial 124 are broken after the projectile 100 is launched and the two luminescent dye components 123,125 are allowed to mix and react. The piercing of the front crusher 120,120*a* into the inside cavity of the ampoule 122 further ensures turbulent and thorough mixing of the luminescent dye components.

Figure 4B:
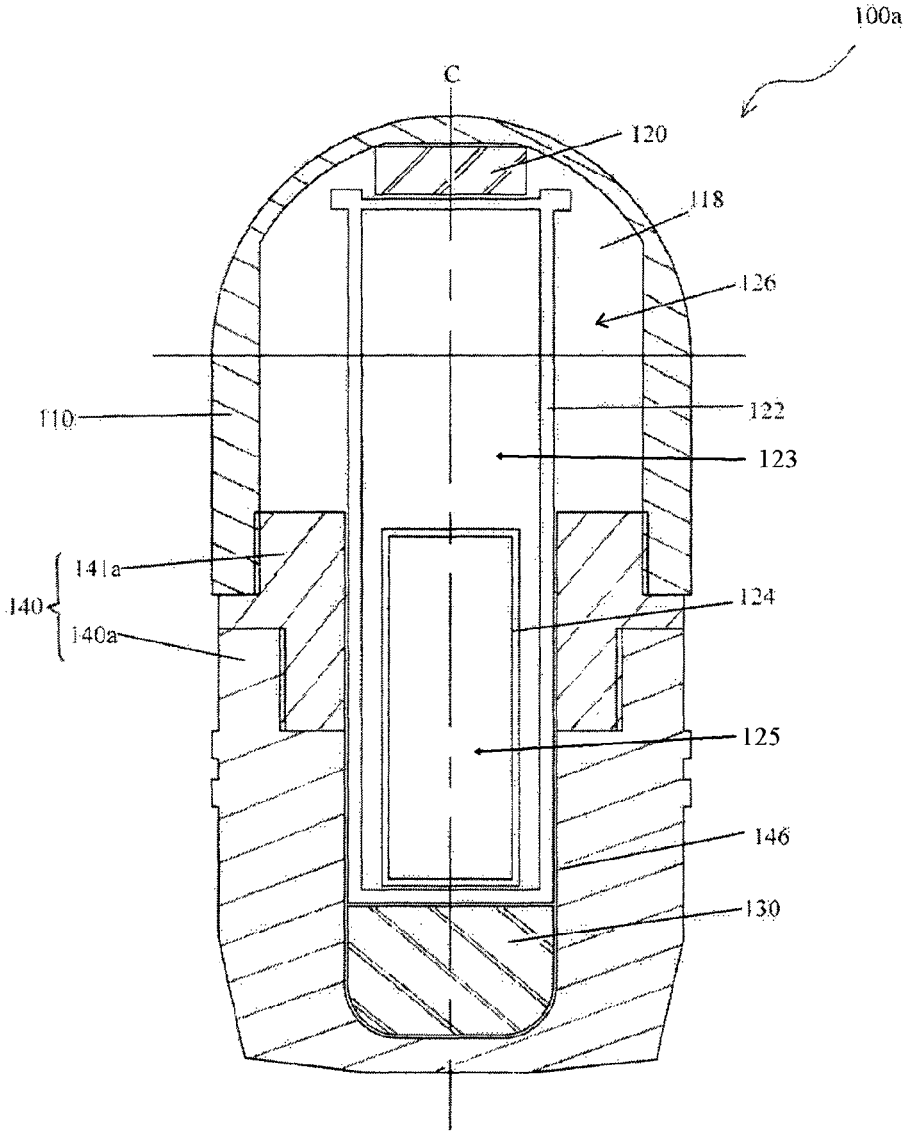
FIG. 4B illustrates a cross-sectional view of a projectile according to another embodiment of the present invention.

FIG. 4B shows a projectile 100*a* according to another embodiment of the present invention. As shown in FIG. 4B, the projectile 100*a* is similar to the projectile of the above embodiment except that a front portion of the projectile body 140 is made up of a separate piece 141*a* that is threaded onto a projectile body 140*a*. By providing the front portion 141*a* of the projectile body 140 as a separate piece, it serves as a filler plug 141*a* for the dye powder 126 and it makes filling of the dye powder 126 into the cavity 118 and subsequent assembly of the projectile 100*a* easier. In another embodiment of the projectile, the dye powder 126 is pre-packed in sachets 126*a*, where each sachet 126*a* is packed into the cavity 118 surrounding the front crusher 120 and ampoule 122.

Figure 4C:
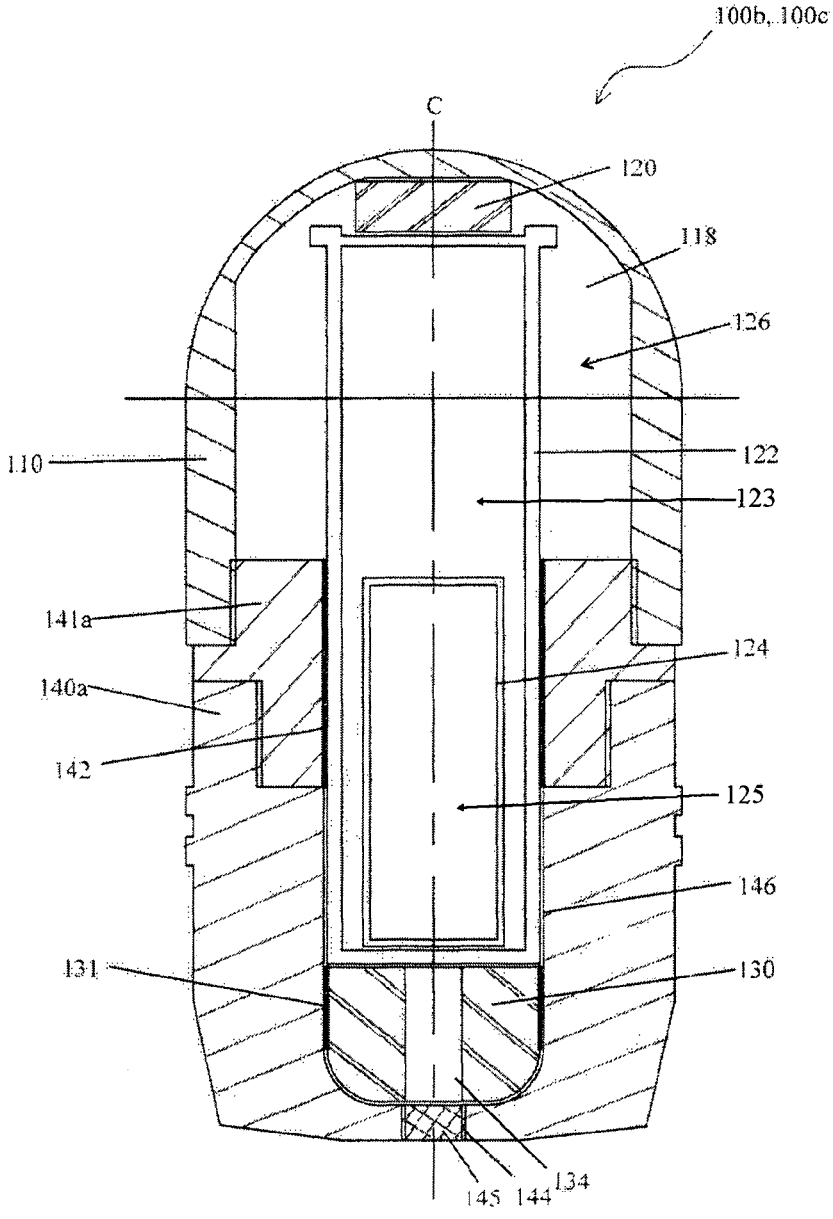
FIG. 4C illustrates a cross-sectional view of a projectile with heat and light tracing according to another embodiment of the present invention.

FIG. 4C shows a projectile 100*b* according to another embodiment of the present invention. As shown in FIG. 4C, the interior cylindrical surface of the filler plug 141*a* is deposited or coated with a compound 142 containing phosphorus, such as red phosphorus. In addition, the outside surface of the rear crusher 130 is deposited or coated with an oxidant 131 that is reactable with the phosphorus compound 142. In use, when the projectile 100*b* strikes a target and the rear crusher 130 is thrown forward, the oxidant 131 on the rear crusher 130*b* comes into contact and rubs into the phosphorus compound 142 on the front portion 141*a* of the projectile body; this causes the phosphorus in the compound 142 to activate and burn. The heat generated by the burning of the compound 142 provides an additional method of establishing a strike point, for example, with the use of thermal imaging cameras.

In a variation of the above embodiment 100*b*, the outside surface of the ampoule 122 is coated with the oxidant 131. In another embodiment, the phosphorus compound 142 is coated on the outside of the ampoule 122 and/or rear crusher 130 whilst the oxidant 131 is deposited on the interior surface of the recess 146 and/or filler plug 141*a*.

In yet another embodiment 100*c* of the projectile, a through hole 134 is provided in the rear crusher 130 along the centre axis C. A hole 144 in register with the through hole 134 is also provided at the rear end of the projectile body 140. The hole 144 is threaded and is fitted with a transparent plug or window 145. In one embodiment, the transparent plug 145 is made of clear polycarbonate; for use with this embodiment, outlet channels of the cartridge 160 direct propulsion gases at an angle to the centre axis C to divert the propulsion gases from the polycarbonate plug 145 and minimise burning it. In flight, light from the luminous dye inside the ampoule 122 is emitted through the holes 134,144 and plug 145 as the projectile 100*c* travels to its target. In this way, the luminous light seen at the rear of the flying projectile 100*c* is useful for plotting or tracing its trajectory, for example, during training purposes. An advantage of this projectile 100*c* is that luminous light from the projectile 100*c* is not seen by its target, especially when the nose cap 110 is translucent or opaque.

Figure 4D:
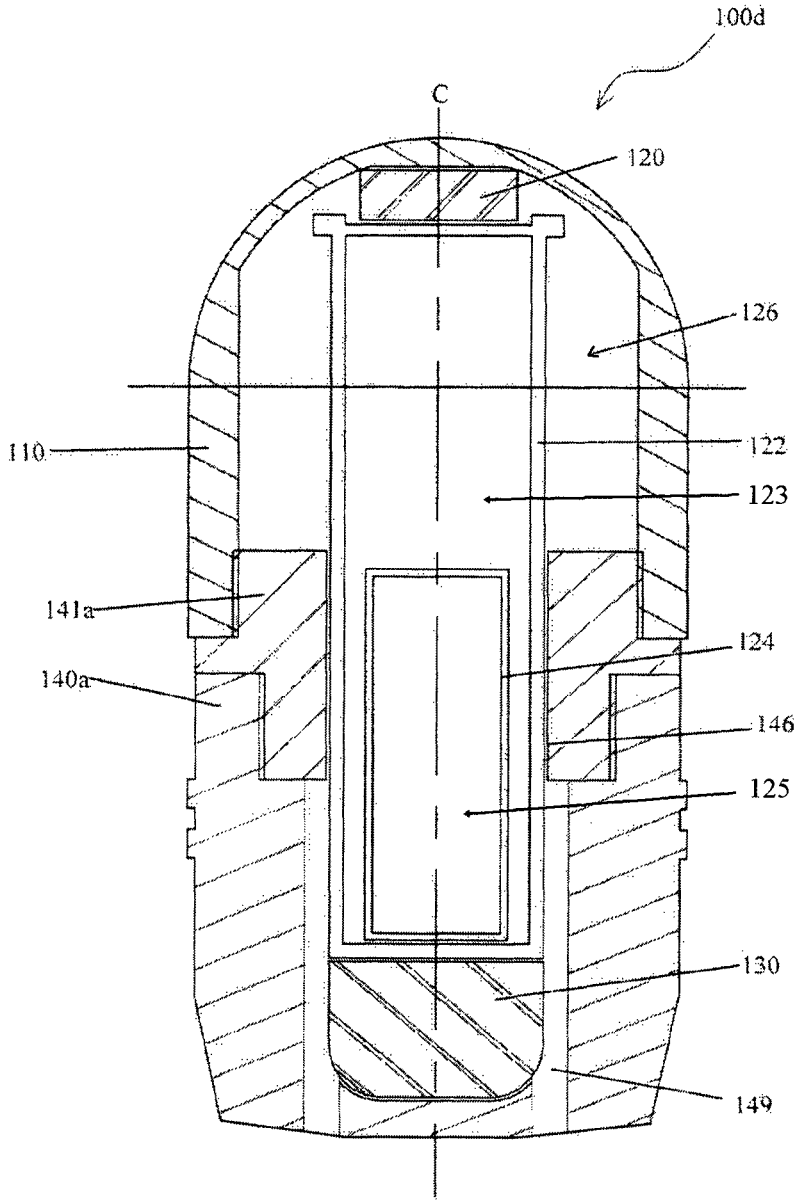
FIG. 4D illustrates a cross-sectional view of a projectile for use in cold environment according to yet another embodiment of the present invention.

FIG. 4D shows a projectile 100*d* according to yet another embodiment of the present invention. As shown in FIG. 4D, the projectile 100*d* is similar to the above projectiles 100*b*, 100*c* except that the rear end of the projectile body 140*a* has channels 149, which communicate the recess 146 to the rear end of the projectile body. The number of the channels may range from one to three. Whilst the number and size of the channels 149 are not limiting, the channels 149 allow hot propulsion gases to convect heat to the ampoule 122 and vial 124 when the projectile 100*d* is still in flight to its target. With this embodiment, when the projectile 100*d* is used in a cold environment, heat from the propulsion gases can thaw the luminescent dye components 123,125 and thus allow the luminescent dye to glow more effectively. Advantageously, these channels 149 serve as windows for the luminous glow from the luminescent dye to emit out of the rear of the projectile body 100*d* for trajectory tracing and there may be no need for the transparent plug/window 145. When the projectile 100*d* is provided with phosphorus compound 142 and associated oxidant 131, as in the previous embodiment, the heat generated by the burning of the phosphorus compound 142 will provide additional thawing of the luminescent dye, thus further ensuring that the projectile 100*d* is usable in cold environment.

In the above embodiments, ballistic performance of the projectiles 100,100*a*,100*b*, etc. is desirably as close as possible to the ballistic performance of projectiles in service. To achieve this, tests with projectiles made of different materials and mass distributions of the components were carried out. In addition, safety tests, such as drop test, were carried out to ensure that these projectiles 100,100*a*,100*b*, etc. are strong enough to withstand handling during transportation and foreseeable types of mishandling.

While specific embodiments have been described and illustrated, it is understood that many changes, modifications, variations and combinations thereof could be made to the present invention without departing from the scope of the present invention. For example, a larger caliber projectile may be configured with a front crusher, an ampoule containing a luminescent dye component, a vial contained within the ampoule and holding a second luminescent dye component, a rear crusher and dye powder surrounding the ampoule and front crusher, so that a strike point is visually marked with the dye powder during day training and with luminescent dye during night training. In another example, a grenade may also be similarly configured according to the teaching of the present invention. In another example, the materials of the ampoule and vial are not limited, respectively, to plastic and glass; they can be made of other materials to store the luminescent dye components.

The invention claimed is:

1. A projectile having a hollow nose cap threadedly connected to a forward portion of a projectile body and a cartridge case bonded to a rear portion of said projectile body, such that said projectile is elongate and defines a longitudinal axis; wherein said projectile comprises:

an ampoule disposed inside said hollow nose cap, with said ampoule's longitudinal axis substantially coaxial with said longitudinal axis of said projectile, and said ampoule contains a first luminescent dye component;

a vial disposed inside said ampoule, with said vial containing a second luminescent dye component;

a front crusher disposed at a front end of said ampoule; and a rear crusher disposed at a rear end of said ampoule;

wherein upon launching of said projectile, impulse of said front crusher crushes said front end of said ampoule and said vial, thereby allowing said first and second luminescent dye components to mix and produce a luminous glow, and upon said projectile striking a target, said nose cap breaks and then said rear crusher throws said luminous dye out of said broken nose cap to mark the point of impact of said projectile.

2. A projectile according to claim 1, further comprising a dye powder disposed around said ampoule and front crusher.

3. A projectile according to claim 2, further comprising a filler plug to keep said dye powder in place after said inside hollow of said nose cap is filled.

4. A projectile according to claim 3, wherein said dye powder is contained in a sachet.

5. A projectile according to claim 3, wherein said filler plug has a hole at its centre for receiving said ampoule.

6. A projectile according to claim 2, wherein said dye powder comprises a catalyst that is reactable with said luminescent dye to produce a glow that is stronger than said-luminous glow of only, said luminescent dye.

7. A projectile according to claim 1, wherein said front crusher, ampoule and rear crusher are substantially coaxial along said longitudinal axis of said projectile.

8. A projectile according to claim 7, wherein external dimensions of said ampoule and rear crusher are substantially the same.

9. A projectile according to claim 1, wherein said front crusher is relatively smaller than an interior dimension of said ampoule.

10. A projectile according to claim 9, wherein a rear face of said front crusher has a cutting edge that is in contact with said front end of said ampoule.

11. A projectile according to claim 1, wherein said ampoule is made of a plastic material whilst said vial is made of glass, or vice versa.

12. A projectile according to claim 1, wherein said rear crusher is disposed in a recess that opens from said forward portion of said projectile body.

13. A projectile according to claim 12, wherein an interior surface(s) of said recess and/or said filler plug is/are deposited with a phosphorus compound and an exterior surface(s) of said rear crusher and/or ampoule is/are deposited with an oxidant that is reactable with said phosphorus compound.

14. A projectile according to claim 12, wherein an interior surface(s) of said recess and/or said filler plug is/are deposited with an oxidant and an exterior surface(s) of said rear crusher and/or ampoule is/are deposited with a phosphorus compound that is reactable with said oxidant.

15. A projectile according to claim 12, wherein said rear portion of said projectile body comprises a channel that communicates said recess to said rear of said projectile body.

16. A projectile according to claim 1, wherein said rear portion of said projectile body comprises a centre hole that is plugged with a transparent polycarbonate plug.

17. A method of marking a strike point of a projectile noticeable, said method comprising:

breaking an ampoule and a vial contained in said ampoule by a front crusher during launching of said projectile, mixing two luminescent dye components separately contained in said ampoule and vial to give a luminous glow;

breaking open a nose cap of said projectile along a line of thickness transition upon impact at a strike point; and sputtering said luminous dye out of said broken nose cap by a rear crusher to mark the strike point;

wherein said method is used during the night and with the aid of a night vision camera.

18. A method according to claim 17, further comprising:

catalysing said luminescent dye with a dye powder to give said luminescent dye a stronger glow.

19. A method according to claim 17, further comprising channeling heat from propulsion gas from a rear of said projectile body to said ampoule and vial to thaw said luminescent dye components when said projectile is used in a cold environment.

20. A method of marking a strike point of a projectile noticeable, said method comprising:

breaking an ampoule and a vial contained in said ampoule by a front crusher during launching of said projectile, mixing two luminescent dye components separately contained in said ampoule and vial to give a luminous glow;

breaking open a nose cap of said projectile along a line of thickness transition upon impact at a strike point;

sputtering said luminous dye out of said broken nose cap by a rear crusher to mark the strike point; and sputtering a dye powder out of said broken nose cap; wherein said method is used during both day and night.

21. A method according to claim 20, further comprising:

catalysing the luminescent dye with said dye powder to give the luminescent dye a stronger glow.

22. A method according to claim 20, further depositing a phosphorus compound and associated oxidant separately on two cooperating surfaces, and allowing said oxidant and phosphorus compound to rub and ignite and thus providing a thermal glow as said rear crusher is thrown out of said projectile body at the point of impact;

wherein said method is used with the aid of a thermal imaging camera.

23. A method according to claim 20, further comprising tracing said luminous glow that is emitted through a transparent plug disposed at a rear of said projectile body.

24. A method according to claim 20, further comprising channeling heat from propulsion gas from a rear of said projectile body to said ampoule and vial to thaw said luminescent dye components when said projectile is used in a cold environment.

* * * * *